US010406554B2

(12) United States Patent
Seferi

(10) Patent No.: US 10,406,554 B2
(45) Date of Patent: Sep. 10, 2019

(54) GLUE PEN

(71) Applicant: Acme United Corporation, Fairfield, CT (US)

(72) Inventor: Nicholas L. Seferi, Southbury, CT (US)

(73) Assignee: Acme United Corporation, Fairfield, CT (US)

( * ) Notice: Subject to any disclaimer, the term of this patent is extended or adjusted under 35 U.S.C. 154(b) by 0 days.

(21) Appl. No.: 15/377,020

(22) Filed: Dec. 13, 2016

(65) Prior Publication Data

US 2017/0282208 A1 Oct. 5, 2017

Related U.S. Application Data

(60) Provisional application No. 62/316,828, filed on Apr. 1, 2016.

(51) Int. Cl.
*B05C 17/005* (2006.01)

(52) U.S. Cl.
CPC .... *B05C 17/0053* (2013.01); *B05C 17/00546* (2013.01)

(58) Field of Classification Search
CPC ..... B05C 17/0053; B05C 17/00526; B05C 17/00546; B65D 83/0038
USPC ..... 222/146.2, 146.5, 336, 340, 391
See application file for complete search history.

(56) References Cited

U.S. PATENT DOCUMENTS 3,612,357 A * 10/1971 Ruskin ..... B05C 17/0053 219/230
D315,283 S 3/1991 De Carolis et al.
D316,215 S 4/1991 Belanger
D398,204 S 9/1998 Lee
D399,719 S 10/1998 Mignanelli
D402,518 S 12/1998 Lee
D404,622 S 1/1999 Singleton
D406,992 S 3/1999 Cheng
5,876,502 A 3/1999 Sugimura et al.
5,881,912 A 3/1999 Bokros
5,881,923 A 3/1999 Bokros
5,881,924 A 3/1999 Bokros
5,895,159 A 4/1999 Liou
5,901,881 A * 5/1999 Wang ..... B05C 17/00526 126/401
D412,432 S 8/1999 Bokros
D412,650 S 8/1999 Bokros
D414,663 S 10/1999 Bokros
5,984,246 A 11/1999 Gardner
(Continued)

FOREIGN PATENT DOCUMENTS

DE 000002915225 11/1979
DE 000003346254 7/1987
(Continued)

*Primary Examiner* — Nicholas J. Weiss
(74) *Attorney, Agent, or Firm* — Alix, Yale & Ristas, LLP

(57) ABSTRACT

An ergonomic glue pen employs a spring-loaded advancing assembly for advancing a glue stick toward a heater. When the proper temperature is reached, a trigger is depressed to dispense glue through a forward nozzle. In some embodiments, the nozzle changes color when the proper temperature is obtained. A button at the side of the glue pen is manually displaceable by the user. The glue stick is loaded at the rear of the glue pen via a one-way collet. The trigger preferably interacts with the advancing assembly via a spring-loaded ratchet mechanism.

19 Claims, 16 Drawing Sheets

(56) References Cited

U.S. PATENT DOCUMENTS 5,988,445 A 11/1999 Massena
6,056,165 A 5/2000 Speranza
6,065,888 A 5/2000 Maayeh
6,066,689 A 5/2000 Columbus et al.
6,105,824 A 8/2000 Singleton
D433,301 S 11/2000 Pack
6,202,892 B1 3/2001 Lasko
6,268,413 B1 7/2001 Columbus et al.
D455,620 S 4/2002 Lee
6,412,667 B1 7/2002 Huang
6,457,889 B1 10/2002 Lin
D469,670 S 2/2003 Belanger
D474,949 S 5/2003 Schaffeld et al.
6,558,059 B1 5/2003 Hillinger et al.
6,652,175 B2 * 11/2003 Chang ..... B05C 17/0053 219/229
6,747,251 B1 6/2004 Belanger
6,766,923 B1 7/2004 Huang
D496,239 S 9/2004 Levine et al.
6,820,768 B2 * 11/2004 Belanger ..... B05C 17/00526 222/146.5
D505,845 S 6/2005 Lin et al.
D510,243 S 10/2005 Lee
D511,077 S 11/2005 Huang
D514,406 S 2/2006 Lee
D514,408 S 2/2006 Melendy et al.
D517,880 S 3/2006 Melendy et al.
D535,167 S 1/2007 Monfeli et al.
D554,960 S 11/2007 Deal et al.
D557,605 S 12/2007 Reber, II et al.
D576,458 S 9/2008 Arns
D590,674 S 4/2009 Belanger
7,520,408 B1 4/2009 Smith et al.
7,776,173 B2 8/2010 Schumacher et al.
D671,385 S 11/2012 Yung-Kuan
D714,866 S 10/2014 Heipp et al.
D719,038 S 12/2014 Heipp et al.
D724,400 S * 3/2015 Filian ..... D8/30
D744,305 S 12/2015 Huang
D748,444 S 2/2016 Huang
2002/0192005 A1 12/2002 Chang
2004/0232165 A1 11/2004 Lee
2006/0196888 A1 * 9/2006 Agronin ..... B05C 17/0053 222/146.5
2008/0197155 A1 8/2008 Liang
2008/0223511 A1 9/2008 Schumacher et al.
2011/0056994 A1 3/2011 Yen
2012/0048889 A1 * 3/2012 Yung-Kuan ..... B05C 17/0053 222/146.5
2015/0209820 A1 7/2015 Ono

FOREIGN PATENT DOCUMENTS

DE 202007003663 7/2007
DE 202007009916 11/2007

* cited by examiner

GLUE PEN

BACKGROUND

This disclosure relates generally to devices for heating glue sticks and dispensing molten glue. More particularly, this disclosure relates to handheld devices for dispensing glue for crafting purposes.

A key feature in the effectiveness of glue pens which dispense molten glue for crafting purposes is the ease of use. If the glue is to be melted by an electric heater, it is desirable that the glue pen be ergonomically designed for facile manipulation to accommodate the electrical cord. In addition, it is important that the heat generated during the melting process not be so excessive to render the pen too hot to use or to render the pen unsafe. Another key consideration is that the pen be relatively easily resupplied with a glue stick and that any glue stick that is employed be efficiently handled so as to avoid jamming and/or discontinue its glue delivery within the pen. All of the foregoing considerations present significant issues in designing a glue pen which is effective and efficient and can be manufactured in a cost effective manner.

SUMMARY

Briefly stated, a glue pen, in one preferred form, comprises an elongated body comprising a forward discharge nozzle and a rearward receiver which is adapted to receive a glue stick. A passageway extends from the receiver to the nozzle. A feed assembly is disposed in the elongated body. The feed assembly comprises a collar engageable against a received glue stick and a spring exerting a force to advance a received glue stick. A heater assembly is disposed in proximity to a forward portion of the passageway. A trigger assembly has a dispensing and a non-dispensing position, and is engageable with the feed assembly. The glue stick is inserted in the receiver and engaged by the feed assembly and is advanced toward the nozzle. The heater assembly generates heat to produce molten glue. The trigger assembly is actuated to a dispensing position, and molten glue is dispensed through the nozzle.

The body defines a pair of opposed longitudinal slots. The feed assembly comprises a member having a ratchet surface and opposed feed buttons. Each button is displaceable along the slot. The trigger assembly has at least one tooth which is engageable at longitudinal positions of the ratchet surface to releasably fix the longitudinal position of the received glue stick.

The receiver preferably comprises a floating one-way locking collar. The trigger assembly comprises a pivotally mounted trigger which is spring biased to a non-dispensing position and is depressible to a dispensing position. The feed assembly also preferably has a locking collar comprising a plurality of angularly spaced resilient fingers with distal grips which inwardly engage a received glue stick.

In one embodiment, a glue pen comprises an elongated body having a forward discharge nozzle and a rearward receiver adapted to receive a glue stick. A passageway extends from the receiver to the nozzle. A feed assembly comprises a longitudinally displaceable feed button. A spring exerts a force to advance a received glue stick. A trigger assembly has a dispensing and a non-dispensing position and is engageable with the feed assembly. A heater is mounted in proximity to a forward portion of the passageway. When a glue stick is inserted in the receiver and is engaged by the feed assembly, the heater is energized and the trigger assembly is actuated to a dispensing position, molten glue is dispensed through the nozzle.

An indicator indicates that the heater has reached a sufficient temperature for transforming a portion of the glue stick into molten glue. The indicator comprises a coating on or adjacent the forward discharge nozzle, wherein the coating turns a distinctive color. The indicator may alternatively comprise an LED which illuminates to indicate that a sufficient temperature has been attained. The glue pen also incorporates a heat shield for the heater. Indicia at the exterior of the elongated body warn that the pen may generate elevated heat.

The feed assembly further comprises a locking collar comprising a plurality of angularly spaced resilient, generally longitudinally extending fingers with distal grips which engage an inwardly received glue stick. The trigger assembly comprises a pivotal member which is biased to a non-dispensing position and is depressible to a dispensing position. The trigger assembly is engageable with the feed assembly in a spring-loaded ratchet-type mechanism. In one embodiment, the feed assembly comprises a member defining a generally cylindrical receiving cavity and an inward rim. The member is biased by a spring and has a longitudinal serrated surface at the exterior.

In another embodiment, a glue pen comprises an elongated body with a forward discharge nozzle and a rearward receiver. The receiver is adapted to receive a glue stick. A passageway extends from the receiver to the nozzle. A feed assembly is disposed in the body and comprises a longitudinally displaceable member which mounts at least one feed button. A spring exerts an advance force on the member. A heater is disposed in proximity to a forward portion of the passageway.

A trigger assembly has a dispensing and a non-dispensing position. The trigger assembly is engageable with the feed assembly in a spring-loaded ratchet-type mechanism. When a glue stick is inserted in the receiver and is engaged by the feed assembly and biased toward the nozzle, and the heater is energized to a temperature for melting a portion of the glue stick and the trigger assembly is actuated to a dispensing position, molten glue is dispensed through the nozzle.

The feed assembly comprises a locking collar having a plurality of angularly spaced longitudinally extending fingers with distal grips which inwardly engage a received glue stick. The member further comprises a longitudinally extending serrated surface. The trigger assembly comprises at least one tooth which intermittently engages with serrations of the serrated surface. The receiver further comprises a spring-loaded knob with a collet which engages a glue stick inserted in the receiver and forms a one-way stop which is releasable by forwardly compressing the knob.

DETAILED DESCRIPTION

Figure 1:
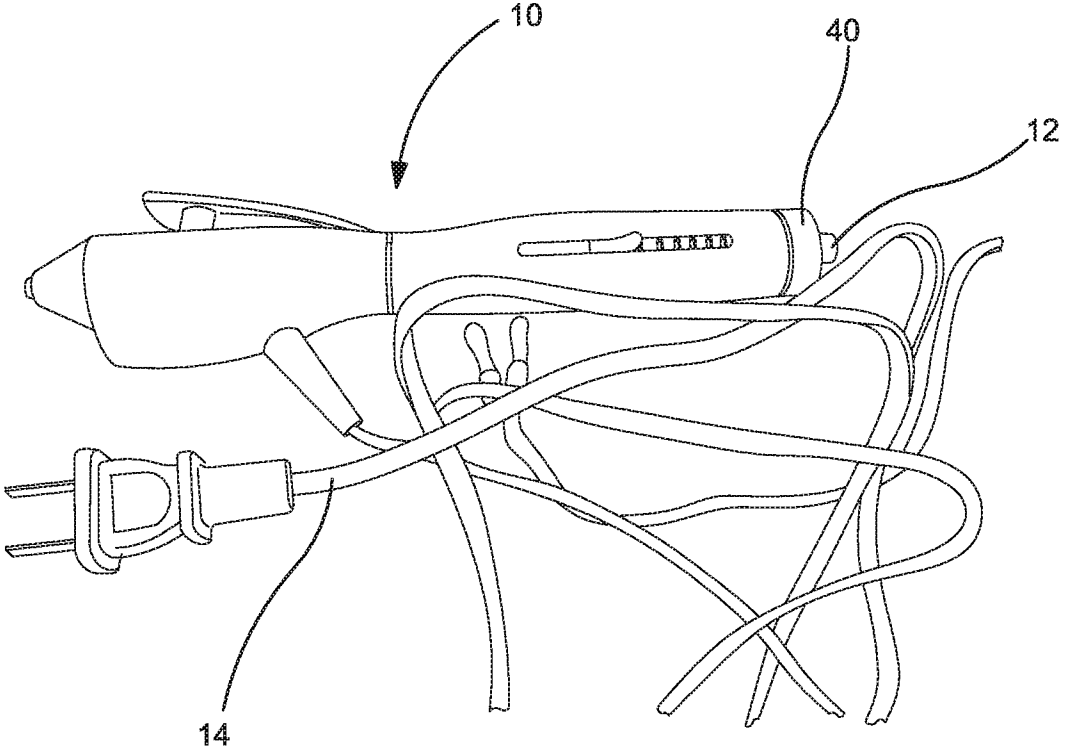
FIG. 1 is a photograph of a glue pen including a portion of a glue stick and an electrical cord for the pen.

With reference to the drawings wherein like numerals represent like parts throughout the several figures, a glue pen is generally designated by the numeral 10. Glue pen 10 functions to receive a glue stick 12 and heat the glue stick to yield molten glue and dispense the molten glue from the glue pen. The glue pen is a handheld device which is particularly adapted for crafting applications. The glue pen preferably receives a glue stick 12. For one embodiment, glue stick 12 has a length of 7 inches. The energy for heating the glue stick is preferably supplied from an electrical cord 14 which connects with a conventional 120V household outlet.

The glue pen 10 has a contoured body 20 with a dispensing head 22 terminating in a forward nozzle 24 having a frontal opening 26. The head 22 connects with a semi-flexible cover sleeve 28 which receives the electrical cord 14.

Figure 5:
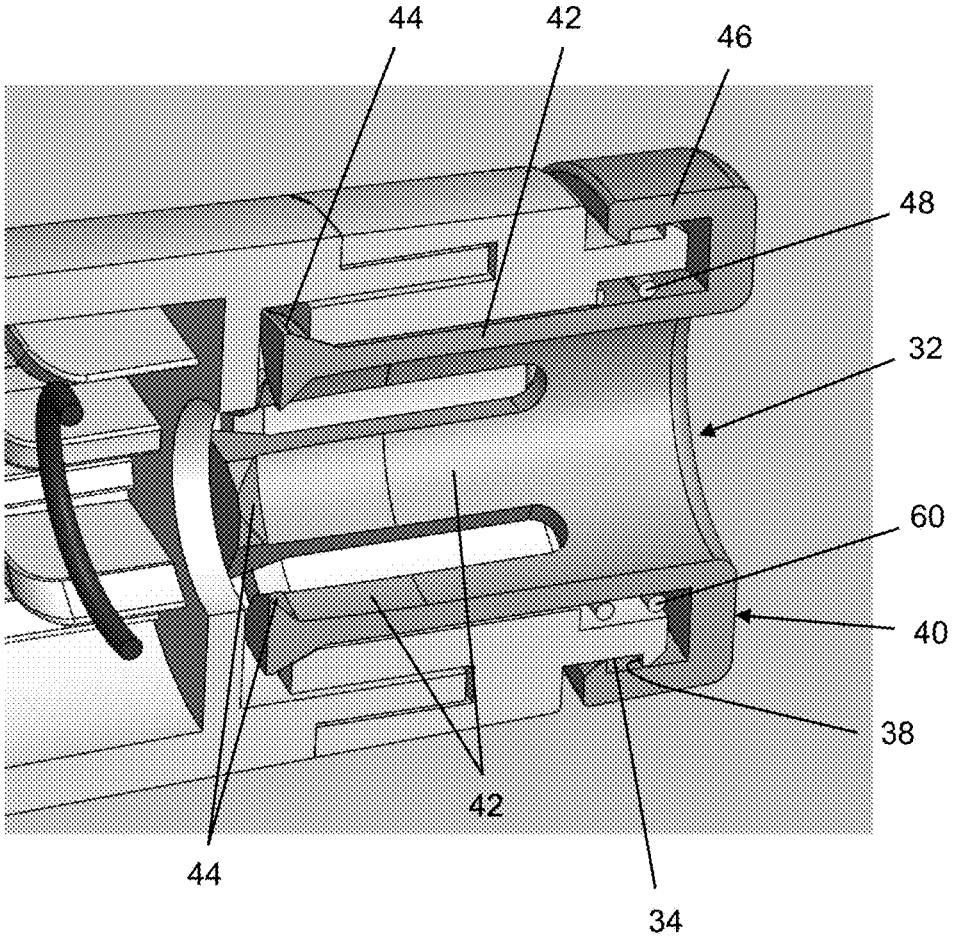
FIG. 5 is an enlarged sectional perspective view, portions removed, of a rear portion of the glue pen of FIG. 1.
Figure 6:
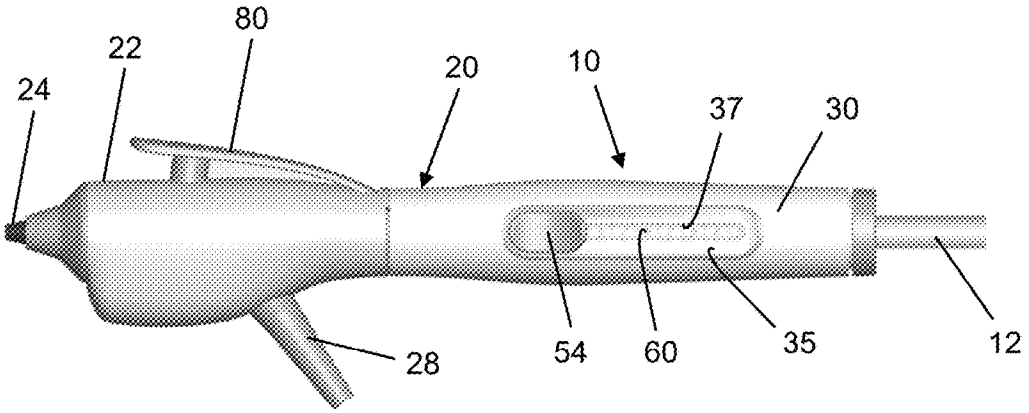
FIG. 6 is a side view of the glue pen of FIG. 1 together with a portion of a received glue stick with the cord being omitted.
Figure 7:
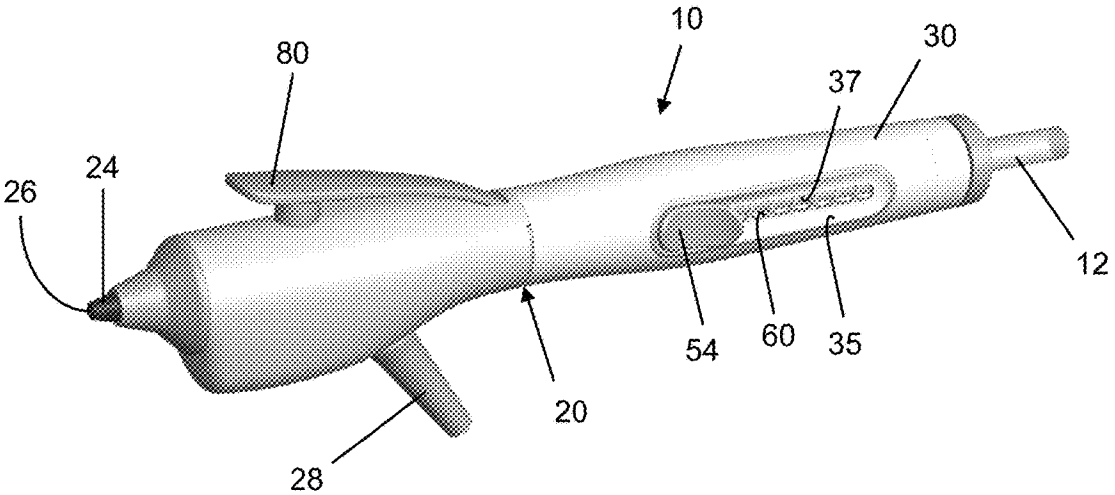
FIG. 7 is a perspective view of the glue pen and glue stick of FIG. 6.
Figure 8:
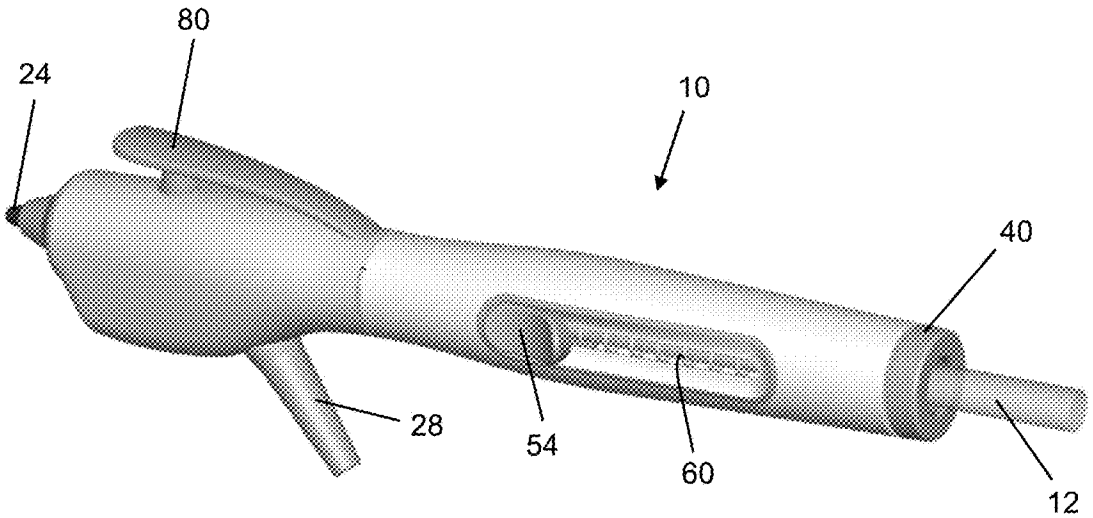
FIG. 8 is a perspective view of the glue pen and glue stick of FIG. 7 from a different perspective thereof.
Figure 9:
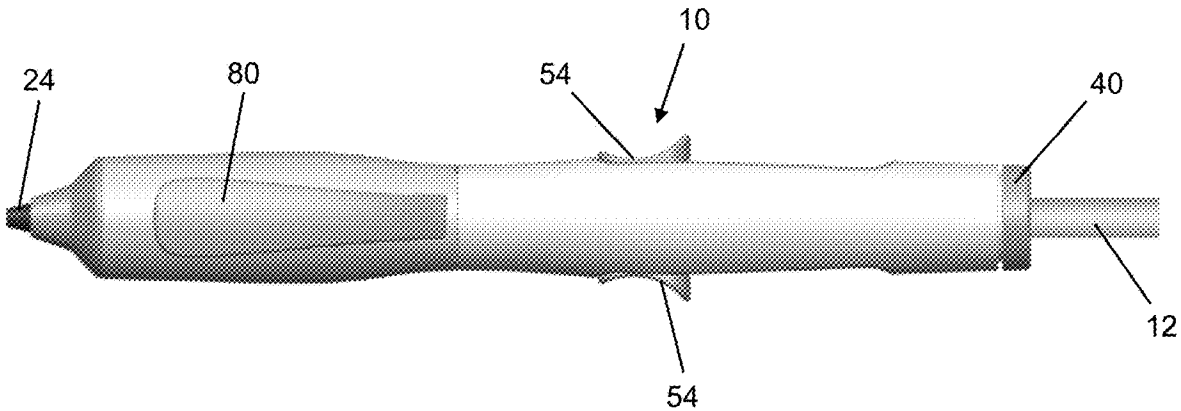
FIG. 9 is a top plan view of the glue pen and glue stick of FIG. 8.
Figure 10:
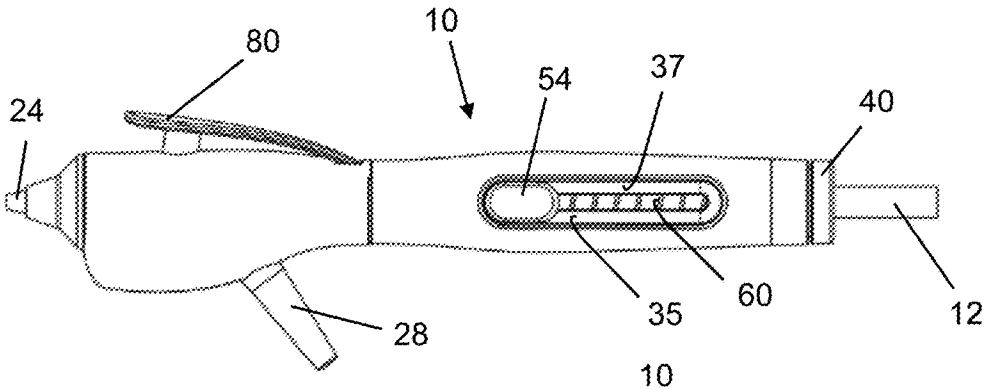
FIG. 10 is a side elevational view of the glue pen of FIG. 1 with a portion of a received glue stick with the cord being omitted.
Figure 11:
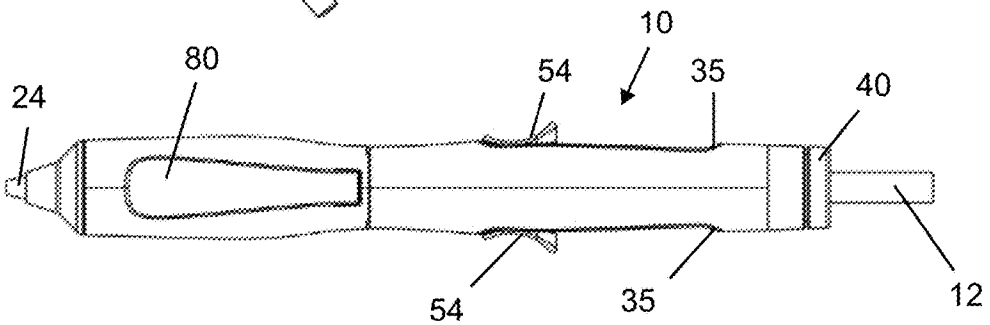
FIG. 11 is a top plan view of the glue pen of FIG. 10.
Figure 12:
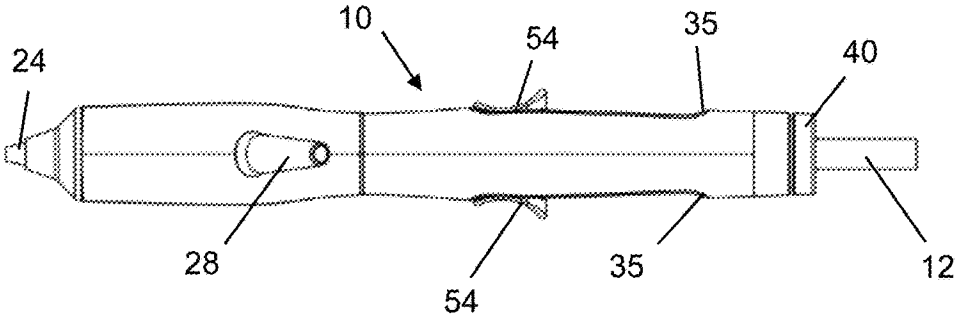
FIG. 12 is a bottom plan view of the glue pen of FIG. 10.
Figure 13:
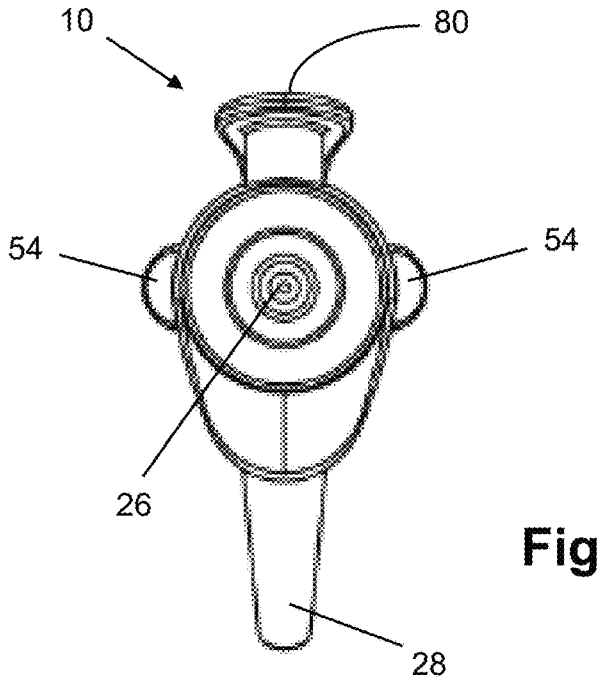
FIG. 13 is a front view of the glue pen of FIG. 10.
Figure 14:
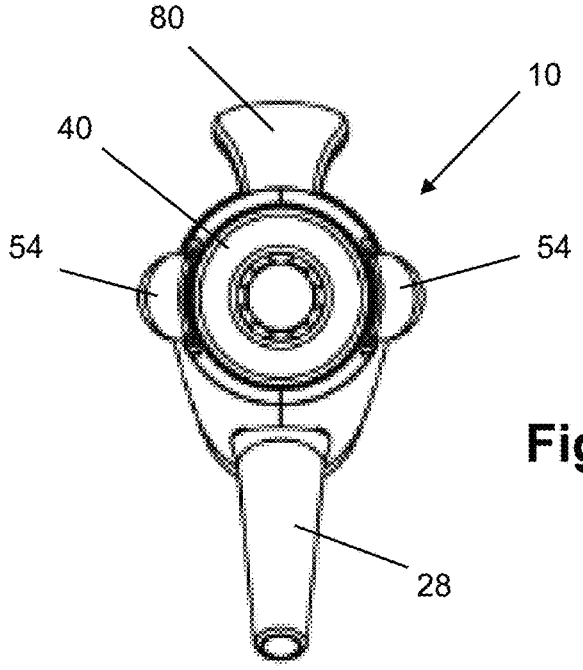
FIG. 14 is a rear view of the glue pen of FIG. 10.
Figure 15:
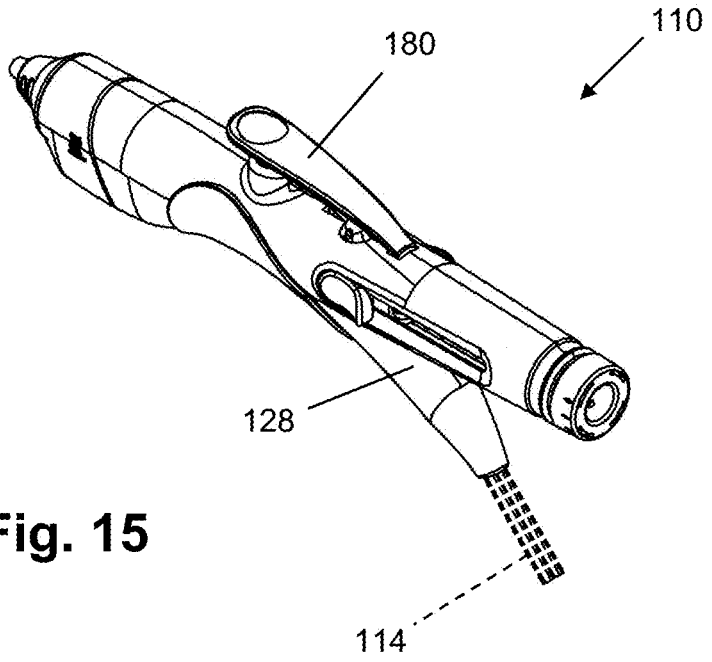
FIG. 15 is a perspective view of a second embodiment of a glue pen, a portion of the electrical cord being shown in broken lines.
Figure 16:
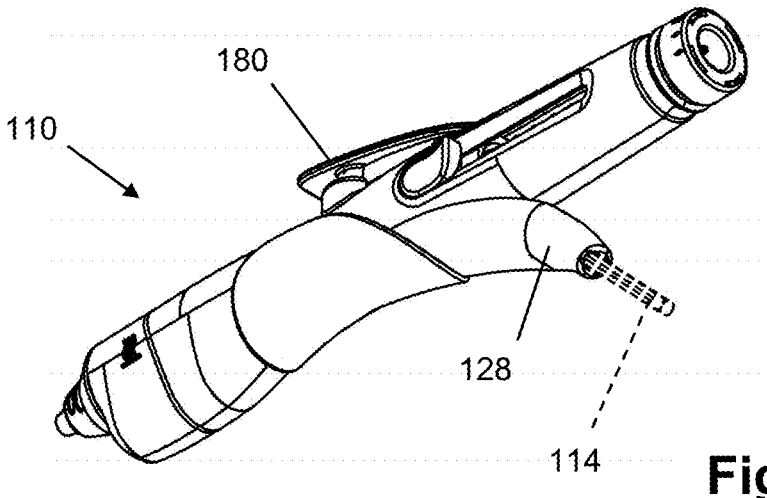
FIG. 16 is a perspective view of the glue pen of FIG. 15 from a different perspective.
Figure 17:
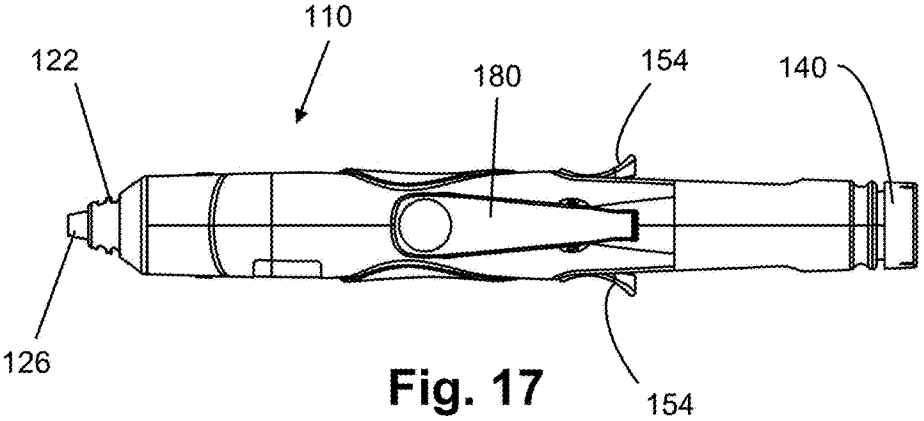
FIG. 17 is a top plan view of the glue pen of FIG. 15.
Figure 18:
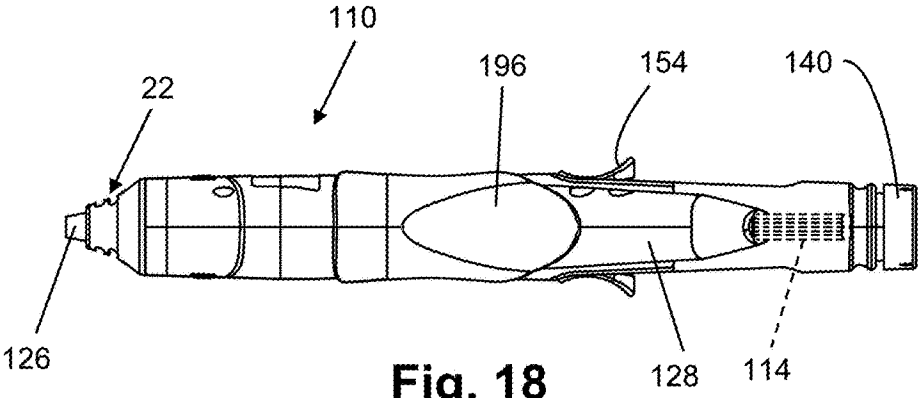
FIG. 18 is a bottom plan view of the glue pen of FIG. 15.
Figure 19:
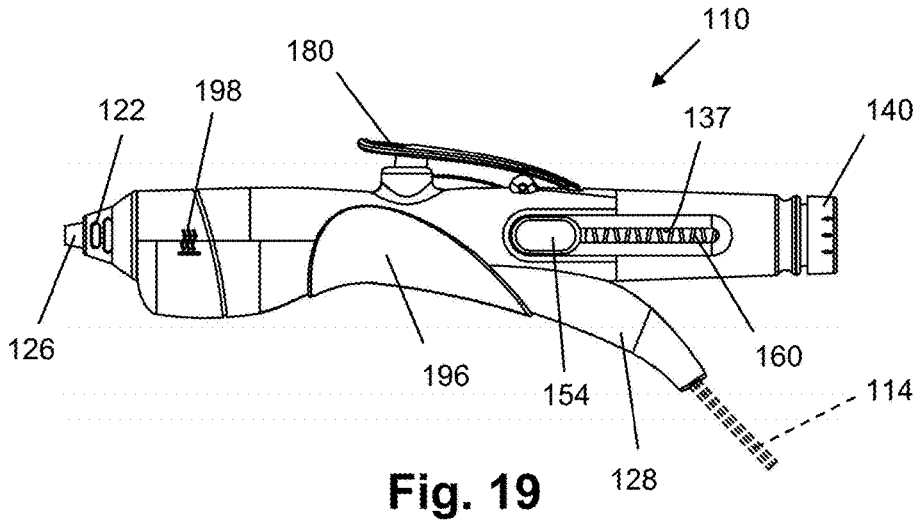
FIG. 19 is a side view of the glue pen of FIG. 15.
Figure 20:
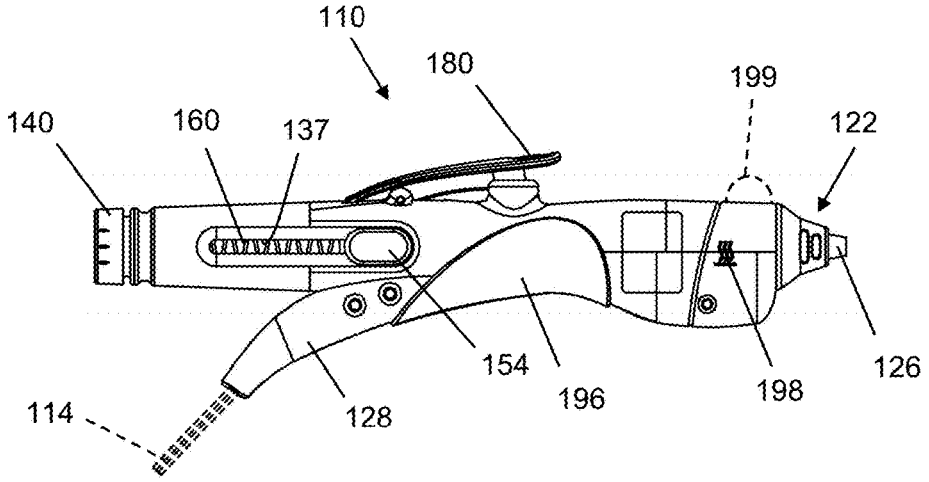
FIG. 20 is an opposite side view of the glue pen of FIG. 15 with an optional LED shown in phantom.
Figure 21:
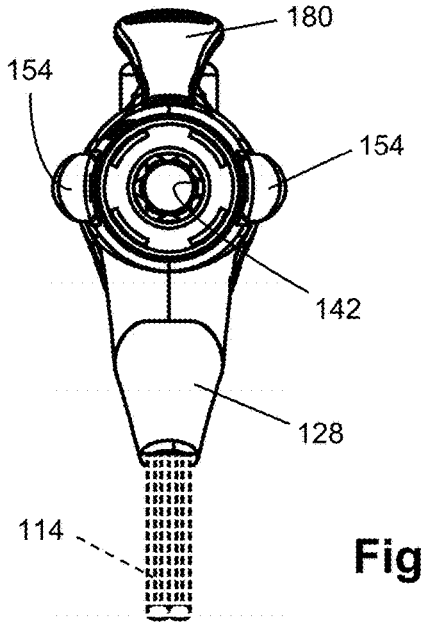
FIG. 21 is an enlarged rear end view of the glue pen of FIG. 15.
Figure 22:
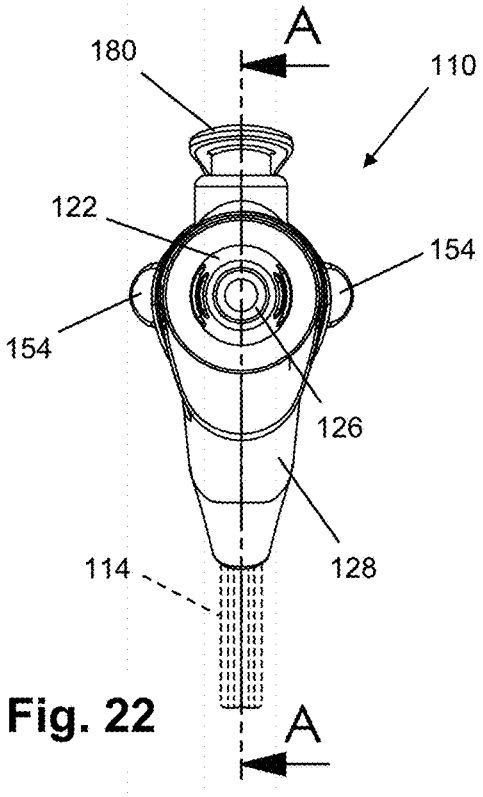
FIG. 22 is an enlarged front end view of the glue pen of FIG. 15.

An elongated contoured receiver tube 30 extends from the dispensing head 22 and is exteriorly configured as a handle for a grasping by the user. With reference to FIG. 5, the rear of the tube has an opening 32 for longitudinally slidably receiving the glue stick 12. The rear of the receiver tube mounts an end cap in the form of a floating one-way locking collar 40. The locking collar has angularly spaced longitudinally extending resilient fingers 42 with projecting grips 44 which inwardly grip around the glue stick. The end of the tube has a circumferential channel 34 defined by longitudinally spaced annular edges 36, 38. The collar includes a U-shaped distal portion having an annulus 46 which inwardly extends to slidably engage along the channel floor and is displaceable between the side walls 36, 38 to essentially retain the collar to the end of the tube in a floating-type relationship. The foregoing end cap assembly thus provides a one-way locking mechanism which allows for the glue to be fed or advanced in the direction of the nozzle without it being backed out.

Figure 2:
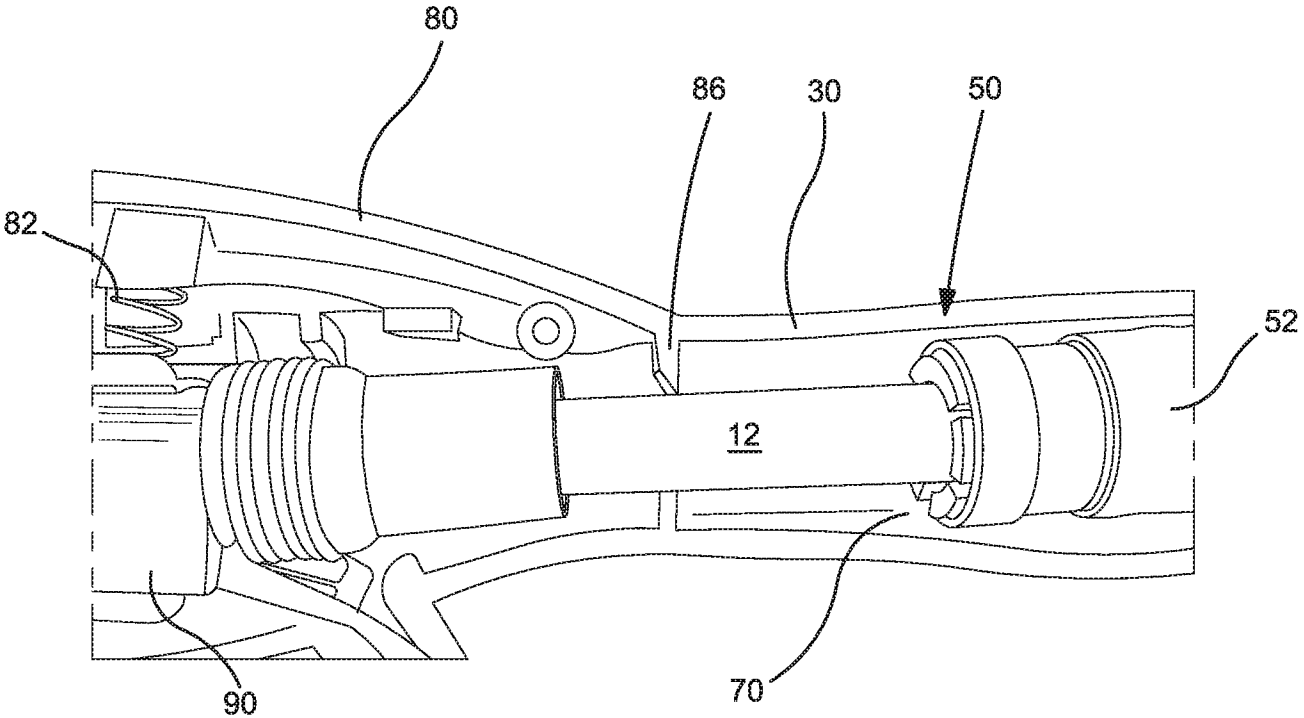
FIG. 2 is an interior view of a portion of the glue pen and glue stick of FIG. 1.
Figure 3:
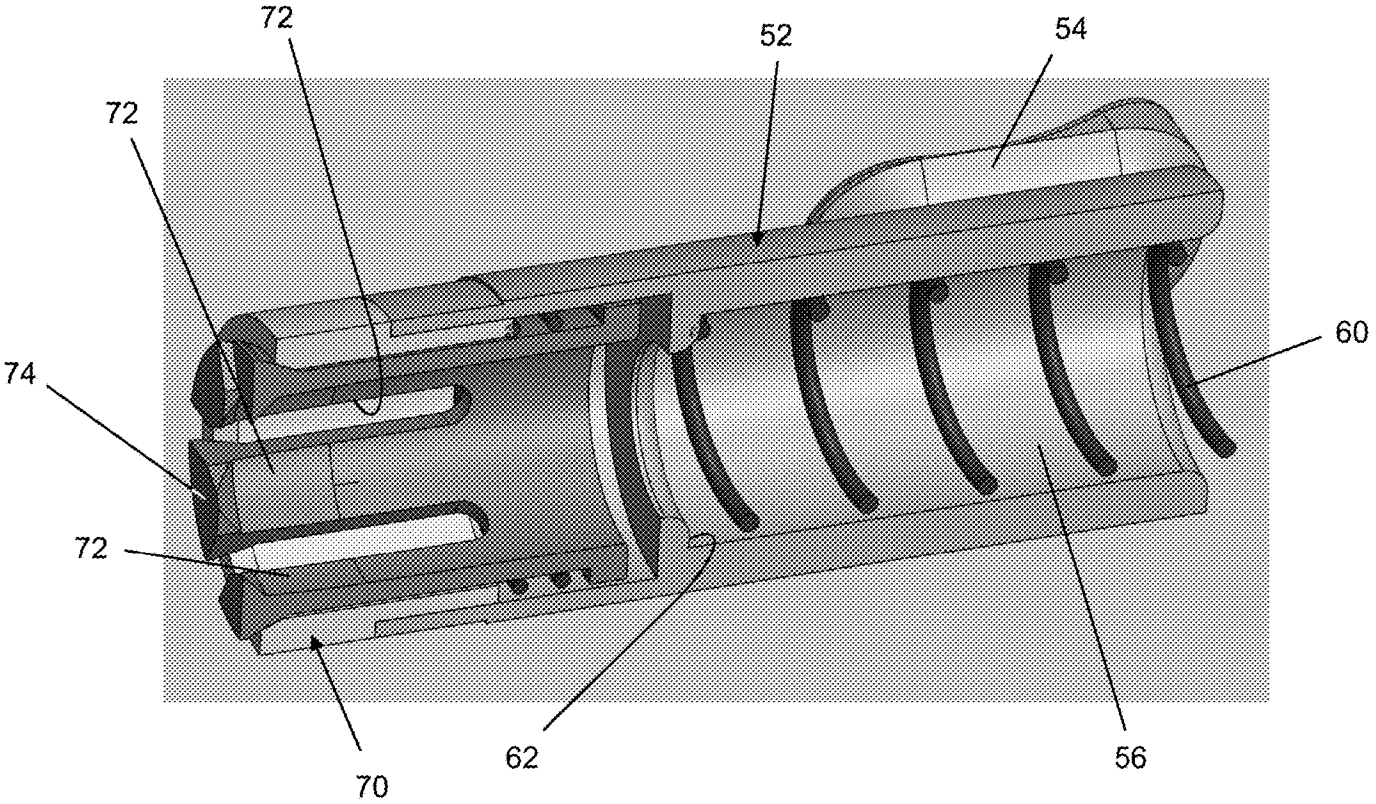
FIG. 3 is an enlarged sectional view, portions removed, of a portion of the glue pen of FIG. 1, illustrating a different operational position thereof.
Figure 4:
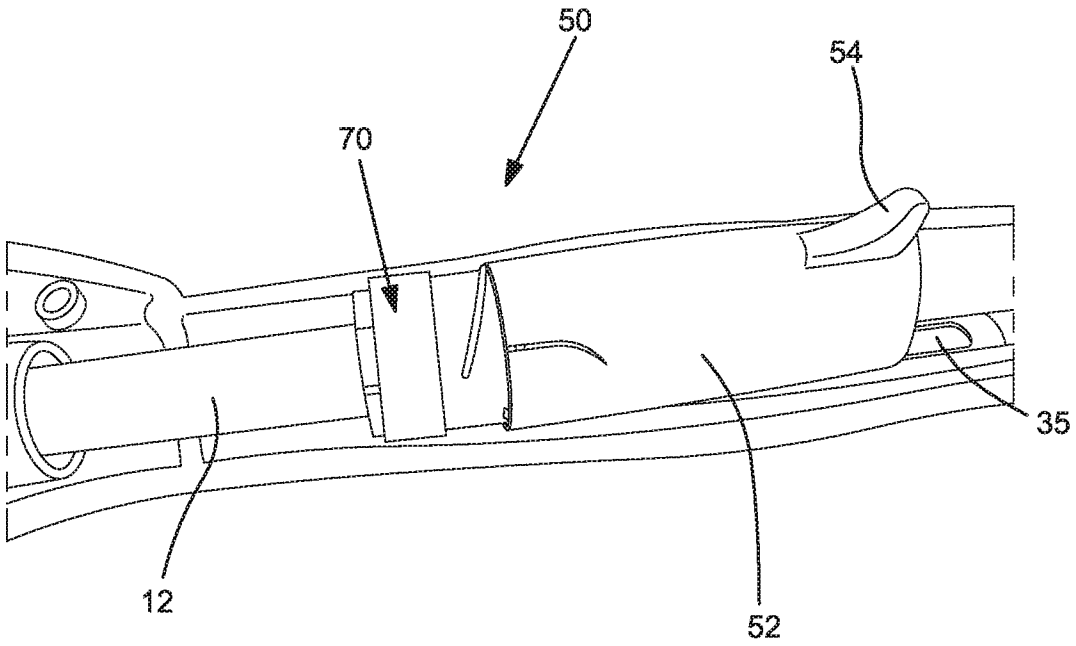
FIG. 4 is an enlarged perspective view, portions removed, of the glue pen and a portion of a glue stick of FIG. 1.

With reference to FIGS. 2-4, it will be appreciated that the interior of the tube essentially forms a longitudinal feed channel. A feed/advance mechanism 50 for the glue stick comprises a carrier 52. The carrier 52 defines a cylindrical chute 56 and encloses a coiled spring 60. The spring 60 controls the feeding of the glue stick. The coiled spring 60 engages between an annular wall 62 of the chute 56 and an annular interior end wall 48 adjacent the collar 40. The carrier 52 has a pair of diametrical opposed buttons 54 which are concurrently longitudinally displaceable along the channel. The tube 30 includes opposed elongated side indentations 35 with a medial longitudinal slot 37. The indentations 35 each exteriorly receive a longitudinally displaceable feed button 54 which is slidable along the track-like slot 37. Each button 54 projects at opposed sides to facilitate engagement by the user.

The coil spring 60 is positioned to exert an advancing force against a forward locking collar 70 extending from the carrier 52. The locking collar 70 has resilient longitudinally extending fingers 72 with distal inward grips 74 which engage the glue stick for forwardly advancing the glue stick. The coiled spring 60 which is retained by the feed/advance mechanism 50 centrally receives the glue stick at the forwardmost end of the inserted glue stick. When the collar and glue stick are fully advanced, the spring 60 is fully extended.

The forward portion of the glue stick is melted by the heater 90. The heater 90 typically operates at 10 watts. A trigger 80 is mounted for exterior pivoting at the top and is biased by a spring 82 (upwardly in the drawings). The trigger 80 functions to selectively operatively provide a non-dispensing and a dispensing mode. Depressing the trigger causes the molten glue to be forced through the nozzle by withdrawing a pivotally positioned spike 86 biased by the spring 82 to engage into and fix the position of the glue stick. The spike 86 keeps the glue stick from advancing and essentially provides a one-way feeding path when the feed button 54 is pulled rearwardly. When it is desired to forwardly advance the glue stick, the spike 86 disengages the glue stick and the cylindrical portion of the feed button assembly moves forwardly to push the glue stick until the coiled spring 60 is fully extended. The dispensing and advancing of the molten glue occurs generally as the trigger is sequentially depressed to a dispensing mode and returned to a non-dispensing mode under the bias of spring 82.

After exhaustion or substantial exhaustion of the first stick, a second stick (not illustrated) is then inserted into the receiver and engaged by the locking collar 70. Feed button 54 is moved rearwardly and advanced forwardly to force any remaining portion of the original glue stick forwardly for melting and ultimately dispensing molten glue through the nozzle 26 by depressing the trigger 80.

With reference to FIGS. 15-24, another embodiment of a glue pen is generally designated by the numeral 110. Structures corresponding to analogous structures of glue pen 10 are designated with the same numerals as for glue pen 10 except that they are preceded by the numeral 1. Glue pen 110 functions in a similar manner and, for the most part, has the same construction as glue pen 10—except for the modifications noted hereafter.

Glue pen 110 is adapted for use with a longer glue stick 112 which is approximately 150-160 mm rather than the standard 100 mm length typically employed for glue pen 10. In general terms from an exterior perspective, glue pen 110 employs a different configuration for nozzle dispensing head 122. The sleeve and strain relief 128, which receives the electrical cord 114, are more rearwardly disposed. It is believed that for some users, the location of the sleeve 128 will be more ergonomically advantageous. The position of the dispensing trigger 180 is also more rearwardly disposed than that of glue pen 10.

Figure 23:
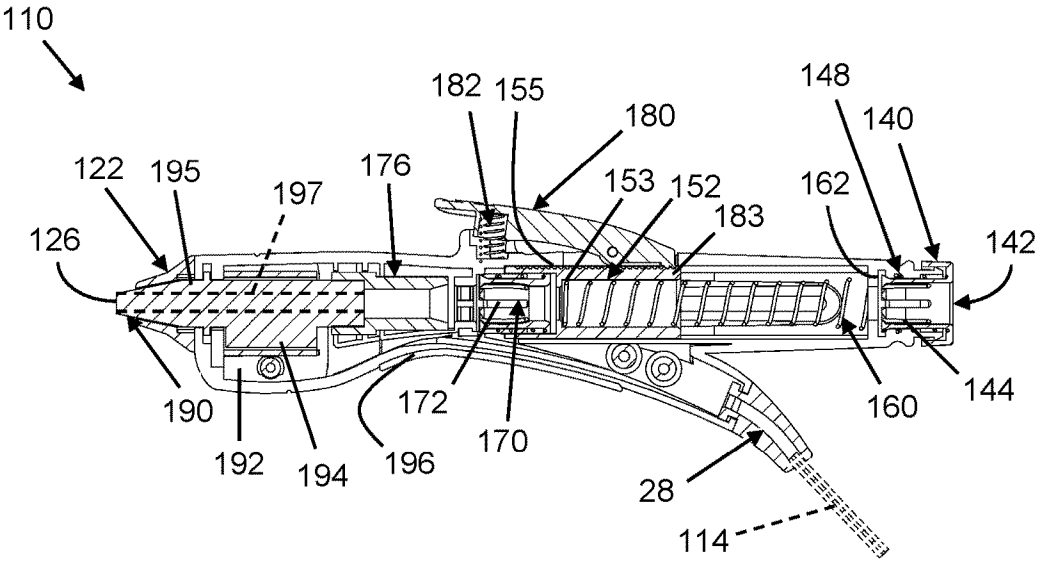
FIG. 23 is a sectional view of the glue pen taken along the line A-A of FIG. 22.
Figure 24:
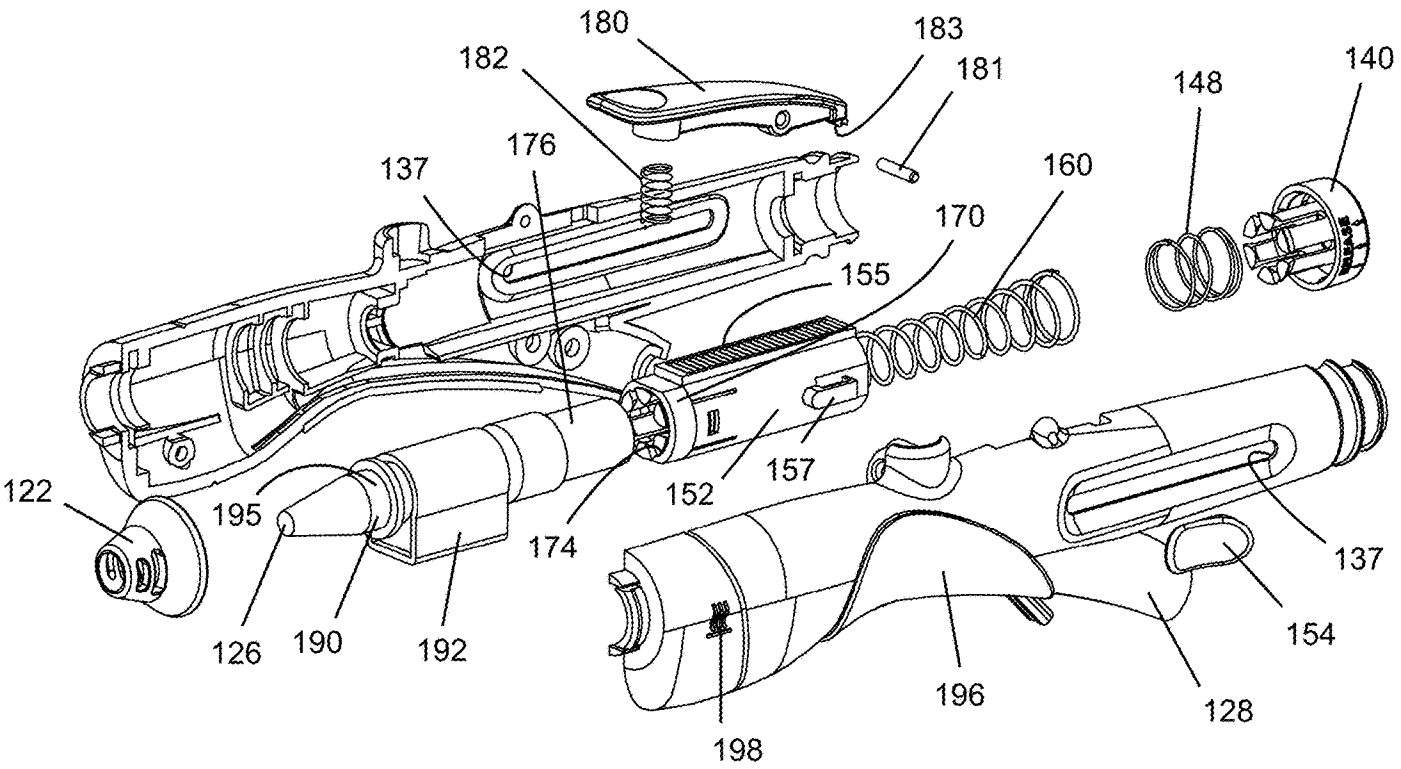
FIG. 24 is an exploded view of the glue pen of FIG. 15.

The heating assembly 190 includes a heat shield 192 for the PTC heating element 194 (FIGS. 23-24). A heat conductive body 195 in conductive communication with heating element 194 defines a central longitudinal channel 197. The channel 197 receives the glue stick and essentially extends to the nozzle opening 126. A contoured exterior cover or grip 196 is mounted for disposition where the pen is gripped by the user to provide an exterior shield for preventing excessive heat from being conducted to the user. In addition, a heat warning notation 198 is affixed to the exterior side of the glue pen 110 to alert the user that the heater may generate heat, and the glue pen may reach an elevated temperature level.

The cover of the nozzle dispensing head 122 has a coating which is temperature sensitive and changes color when the heater is sufficiently heated so that glue can be dispensed. Alternatively, the color responsive coating may be applied to body 195. The coating may be similar to that disclosed in co-pending U.S. patent application Ser. No. 15/333,939 filed on Oct. 25, 2016, the relevant disclosure of which is incorporated herein by reference in its entirety.

Alternatively, an LED 199 (designated by broken lines in FIG. 20) may be employed to indicate that the temperature generated by the heater is sufficient for melting the glue stick and dispensing the molten glue.

With reference to FIGS. 23 and 24, the feeding path and the feeding/dispensing assembly are illustrated for the glue pen 110. The feed path extends from a glue stick release knob 140 which surrounds a receiver opening 142 at the rear end longitudinally through the elongated body 120 and the heater assembly 190 through the nozzle 126 at the forward end of the body. A glue stick (not illustrated in FIGS. 23 and 24) is inserted through the receiver opening 142 past a one-way collet 144 proximate the rear end of the opening until it is passed through a cylindrical cavity or chute of the feeder body 152 to a feeder collet 170 having angularly spaced resilient fingers 172 and grips 174. The glue stick is eventually advanced into the silicon sleeve 176 for passage through a forward passage 197 of the conductive body 195 for PTC heating element 194.

The feeder body 152 includes an inward lip 153 (FIG. 23) which receives a forward end of a coiled feeding spring 160. Spring 160 rearwardly engages against a thickened transverse wall 162 adjacent collet 144. The exterior of the feeder body 152 is traversed by an upper longitudinally serrated ratchet surface 155 which functions as part of a spring-loaded ratchet feed for the glue stick. The feeder body 152 has opposed transverse projections 157 (FIG. 24) which each mount a feeder button 154. The buttons 154 concurrently slide along elongated slots 137 in track-like fashion in the sides of the glue pen. The buttons 154 allow for manual displacement of the feeder body 152 and the captured glue stick.

Figure 23A:
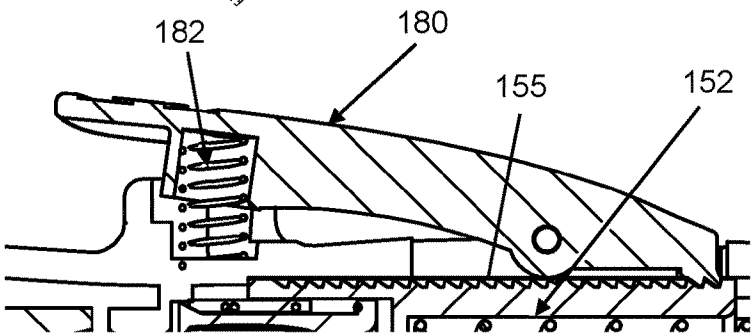
FIG. 23A is an enlarged fragmentary sectional view of the glue pen of FIG. 23.

With additional reference to FIG. 23A, a trigger button 180 is pivotally mounted to the top of the glue pen by a transverse pin 181. The pivotal button includes teeth 183 which are pivotally engageable against the longitudinally displaceable ratchet surface 155. The trigger button 180 is biased by a spring 182 to an upper position which concurrently pivotally forces the teeth 183 into engagement with the serrated ratchet surface 155. Upon depression of the trigger button 180, the teeth 183 disengage, and the glue stick, which is engaged with the feeder collet 170, and is biased by the feeding spring 160, is forwardly advanced into the silicon sleeve 176 and heating body passage 197. Alternatively, a single tooth or pawl may be employed.

When the heating element 192 is sufficiently heated, the trigger button 180 is depressed to feed the forward portion of the glue stick to the heating assembly 190 for dispensing molten glue.

It will be appreciated that the position indicated in FIGS. 23 and 23A is a rearward position of the ratchet engagement which represents the initial position of the feeding mechanism. The feeding body 152 preferably has a quasi-cylindrical shape with opposed integral projections 157 which each mounts a longitudinally positionable feed button 154 of the feeding assembly.

When it is desired to initially insert a glue stick, each feed button 154 is concurrently moved to the rear of the slot 137 at the side of the body and the ratchet surface 155 and feed body 152 will accordingly be moved rearwardly. The glue stick is then inserted into the feeding path until it engages past the feeder collet 170. When a new glue stick is required, it will be inserted into the receiver and manually forced through the collet 170 and forwardly pressed against any remaining portion of the preceding glue stick.

The release knob 140 is biased by a coiled spring 148 at the rear of the pen 110 for providing a one-way stop for engagement by the collet 144. The knob may be forwardly moved to release the collet 144 from engagement with a received glue stick.

Figure 25A:
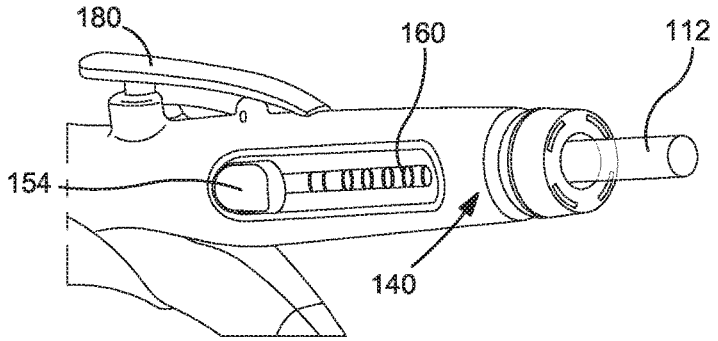
FIGS. 25A-25C are side perspective views with directional arrows illustrating the operation of the glue pen.
Figure 25B:
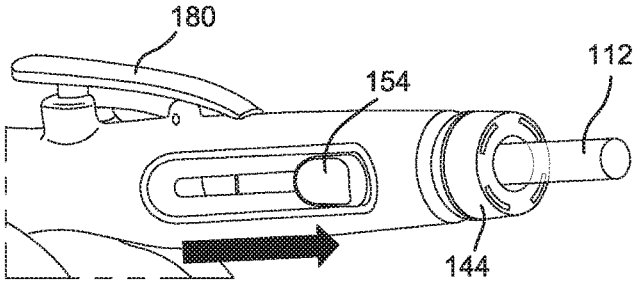
Figure 25C:
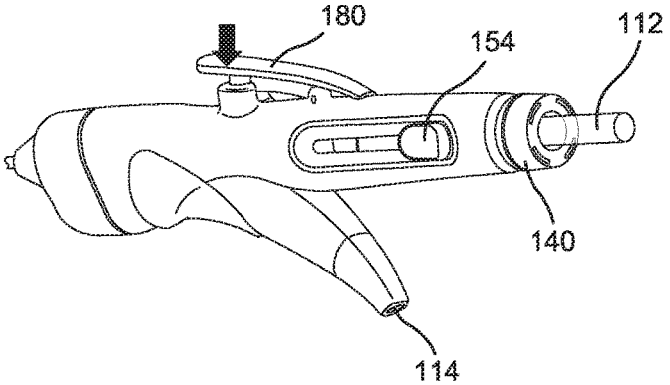

With reference to FIGS. 25A-25C, the operation for the glue pen 110 is further illustrated. The power cord is plugged into a line power socket (not illustrated) and the heating element 194 will begin heating up. The feeding knob 154 is pushed rearwardly, as schematically illustrated. A glue stick 112 is loaded from the rear of the glue pen. When the heater element 194 and conductive body 195 (FIG. 23) are heated to the desired operating temperature, the glue stick can be fed by depressing the trigger button 180, and the glue stick will start to be pushed toward the nozzle 126 where molten glue is dispensed. The operating temperature for changing the phase of the glue stick can be indicated by the head assembly charging color, such as for example, to blue, or the illumination of LED 199. The described feeding mechanism will stop the spring 160 from pushing the glue stick to the front until the trigger dispensing button 180 is pressed down.

As best illustrated in FIGS. 23 and 23A, the dispensing trigger 180 intermittently locks the feeding mechanism in place at various longitudinal positions defined by the serrated surface 155 via a ratcheting engagement. In the glue pen 110, no structure is disposed in the glue stick path to block the glue stick from being moved forwardly into the heater assembly.

The ergonomic features of glue pen 110 are provided so that the power cord will be comfortably disposed over the hand while the pen is being operated by the craftsman.

While preferred embodiments of the foregoing have been set for purposes of illustration, the foregoing description should not be deemed a limitation of the invention herein.

Accordingly, various modifications, adaptations and alternatives may occur to one skilled in the art without departing from the spirit and the scope of the present invention.

The invention claimed is:

1. A glue pen comprising:

an elongated body comprising a forward discharge nozzle and a rearward receiver adapted to receive a glue stick and having a passageway extending from said receiver to said nozzle, said receiver comprising a spring-loaded knob with a collet which inwardly engages a glue stick inserted in said receiver and forms a one-way stop which is releasable by forwardly compressing said knob;

a feed assembly disposed in said elongated body and comprising a collar engageable against the glue stick, and a spring exerting a force to advance the glue stick;

a heater assembly in proximity to a forward portion of said passageway; and a trigger assembly comprising a pivotal lever-like trigger exteriorly extending from said body and having a dispensing position and a non-dispensing position and having a portion engageable with said feed assembly, wherein when a glue stick is inserted in said receiver and engaged by said feed assembly and advanced toward said nozzle, and said heater assembly generates heat, and said trigger assembly is actuated to a dispensing position, molten glue is dispensed through said nozzle.

2. The glue pen of claim 1 wherein said body defines a pair of opposed longitudinal slots, and said feed assembly comprises opposed feed buttons and each button is displaceable along said slot.

3. The glue pen of claim 1 wherein said feed assembly comprises a member having a ratchet surface and said trigger assembly has at least one tooth which is engageable at longitudinal positions of said ratchet surface to releasably fix the longitudinal position of the received glue stick.

4. The glue pen of claim 1 wherein said trigger assembly comprises a pivotally mounted trigger which is spring biased to the non-dispensing position and is depressible to the dispensing position.

5. A glue pen comprising:

an elongated body comprising a forward discharge nozzle and a rearward receiver adapted to receive a glue stick and having a passageway extending from said receiver to said nozzle, said body defining a longitudinal slot;

a feed assembly comprising a feed button actuatable exteriorly of said body and longitudinally displaceable relative to said body along said slot and a spring exerting a force to advance the glue stick;

a heater in proximity to a portion of said passageway; and a trigger assembly having an exteriorly actuating pivotal trigger having a dispensing and a non-dispensing position and engageable with said feed assembly, wherein when a glue stick is inserted in said receiver and engaged by said feed assembly, said heater is energized and said trigger assembly is actuated to a dispensing position, molten glue is dispensed through said nozzle.

6. The glue pen of claim 5 further comprising an indicator which indicates that the heater has reached a sufficient temperature for transforming a portion of said glue stick into molten glue.

7. The glue pen of claim 6 wherein said indicator comprises a coating on or adjacent said forward discharge nozzle which turns a distinctive color.

8. The glue pen of claim 6 wherein said indicator comprises an LED which illuminates to indicate that a sufficient temperature has been attained.

9. The glue pen of claim 5 wherein said feed assembly further comprises a locking collar comprising a plurality of angularly spaced resilient generally longitudinally extending fingers with distal grips which engage an inwardly received glue stick.

10. The glue pen of claim 5 wherein said trigger assembly comprises a pivotal member which is biased to the non-dispensing position and is depressible to the dispensing position.

11. The glue pen of claim 5 further comprising a heat shield for said heater and heat warning indicia at the exterior of said elongated body.

12. The glue pen of claim 5 wherein said trigger assembly is engageable with said feed assembly via a spring-loaded interaction.

13. The glue pen of claim 5 wherein said feed assembly comprises a member having an outer longitudinal serrated surface and defining an inner generally cylindrical receiving cavity, said member being biased by the spring.

14. The glue pen of claim 1 wherein said receiver further comprises a spring-loaded knob with a collet which inwardly engages a glue stick inserted in said receiver and forms a one-way stop which is releasable by forwardly compressing said knob.

15. A glue pen comprising:

an elongated body comprising a forward discharge nozzle and a rearward receiver adapted to receive a glue stick, a passageway extending from said receiver to said nozzle, said receiver comprising a spring-loaded knob with a collet which inwardly engages a glue stick inserted in said receiver and forms a one-way stop which is releasable by forwardly compressing said knob;

a feed assembly disposed in said body and comprising a longitudinally displaceable member which mounts at least one feed button and a spring exerting an advance force with respect to a received glue stick;

a heater in proximity to a forward portion of said passageway; and a trigger assembly having a dispensing and non-dispensing position and engageable with said feed assembly via a spring-loaded mechanism, wherein when a glue stick is inserted in said receiver, engaged by said feed assembly and advanced toward said nozzle, and said heater is energized to a temperature for melting a portion of said glue stick and said trigger assembly is actuated to a dispensing position, molten glue is dispensed through said nozzle.

16. The glue pen of claim 15 wherein said feed assembly comprises a locking collar having a plurality of angularly spaced, generally longitudinally extending fingers which inwardly engage a received glue stick.

17. The glue pen of claim 15 wherein said trigger assembly comprises a pivotally mounted trigger which is biased to a non-dispensing position and is depressible to a dispensing position and extends exteriorly from said elongated body.

18. The glue pen of claim 15 wherein said member further comprises a longitudinally extending serrated surface forming a plurality of serrations, and said trigger assembly comprises at least one tooth which is intermittently engageable with the serrations.

19. A glue pen comprising:

an elongated body comprising a forward discharge nozzle and a rearward receiver adapted to receive a glue stick and having a passageway extending from said receiver to said nozzle, said body defining a pair of opposed longitudinal slots;

a feed assembly disposed in said elongated body and comprising a collar engageable against the glue stick, and a spring exerting a force to advance the glue stick, said feed assembly comprising opposed feed buttons and each button is displaceble along a said slot;

a heater assembly in proximity to a forward portion of said passageway; and a trigger assembly having a dispensing and a non-dispensing position and having at least one lever engageable with said feed assembly, wherein when a glue stick is inserted in said receiver and engaged by said feed assembly and advanced toward said nozzle, and said heater assembly generates heat, and said trigger assembly is actuated to a dispensing position, molten glue is dispensed through said nozzle.

* * * * *